US008654046B2

(12) United States Patent
Kim

(10) Patent No.: US 8,654,046 B2
(45) Date of Patent: Feb. 18, 2014

(54) DISPLAY APPARATUS AND DISPLAYING METHOD THEREOF

(75) Inventor: Hyeong Gwon Kim, Suwon (KR)

(73) Assignee: Samsung Display Co., Ltd., Yongin-si (KR)

( * ) Notice: Subject to any disclaimer, the term of this patent is extended or adjusted under 35 U.S.C. 154(b) by 2069 days.

(21) Appl. No.: 11/165,426

(22) Filed: Jun. 22, 2005

(65) Prior Publication Data

US 2006/0022917 A1 Feb. 2, 2006

(30) Foreign Application Priority Data

Jun. 25, 2004 (KR) ..... 2004-48317

(51) Int. Cl.
*G09G 3/32* (2006.01)

(52) U.S. Cl.
USPC ..... 345/82

(58) Field of Classification Search
USPC ..... 345/46, 55, 83, 87, 690, 77; 315/169.1
See application file for complete search history.

(56) References Cited

U.S. PATENT DOCUMENTS

| | | | | |
|---|---|---|---|---|
| 6,229,267 | B1 * | 5/2001 | Ushigusa et al. | 315/169.4 |
| 6,369,516 | B1 * | 4/2002 | Iketsu et al. | 315/169.3 |
| 6,417,868 | B1 * | 7/2002 | Bock et al. | 345/698 |
| 7,027,013 | B2 * | 4/2006 | Ouellete et al. | 345/76 |
| 7,304,654 | B2 * | 12/2007 | Mori et al. | 345/690 |
| 7,327,391 | B2 * | 2/2008 | Fujino | 348/230.1 |
| 2003/0146977 | A1 * | 8/2003 | Vale et al. | 348/207.1 |
| 2004/0100478 | A1 * | 5/2004 | Bianchi et al. | 345/690 |
| 2005/0134525 | A1 * | 6/2005 | Tanghe et al. | 345/1.1 |

FOREIGN PATENT DOCUMENTS

| | | | | |
|---|---|---|---|---|
| JP | 3-171880 | | 7/1991 | |
| KR | 10-1996-012962 | | 4/1996 | |
| KR | 10-1998-023130 | | 7/1998 | |
| KR | 10-2000-0008685 | | 2/2000 | |
| WO | WO03058593 | * | 7/2003 | G09G 3/30 |

OTHER PUBLICATIONS

Patent Abstract of Japan No. 03-171880, Published on Jul. 25, 1991, in the name of Yushikuni, et al.
Patent Abstract of Korea No. 10-1996-012962, Published on Apr. 20, 1996,in the name of Daewoo Electronics Co., Ltd.
Patent Abstract of Korea No. 10-1998-023130, Published on Jul. 6, 1998, in the name of Daewoo Electronics Co., Ltd.
Patent Abstract of Korea No. 10-2000-0008685, Published on 02-15-200, in the name of LG Electronics, Co., Ltd.

* cited by examiner

*Primary Examiner* — James Wozniak
*Assistant Examiner* — Calvin C Ma
(74) *Attorney, Agent, or Firm* — Christie, Parker & Hale, LLP

(57) ABSTRACT

A display apparatus and a displaying method thereof can improve picture quality. The display apparatus includes: a light emitting display; a camera module to take a picture; a brightness controller to generate a voltage corresponding to a gradation value of image data transmitted from the camera module based on a gamma curve, and to apply the generated voltage to the light emitting display; a controller to control the camera module and the brightness controller; and an image compensator to create a control value on the basis of an average of first brightness data corresponding to a predetermined region of a frame data transmitted from the camera module, and an average value of second brightness data transmitted from the controller corresponding to the other regions of the frame data. In the display apparatus, the controller resets at least one of amplitude and a gradient of the gamma curve on the basis of the control value.

25 Claims, 9 Drawing Sheets

DISPLAY APPARATUS AND DISPLAYING METHOD THEREOF

CROSS-REFERENCE TO RELATED APPLICATION

This application claims priority to and the benefit of Korean Patent Application No. 10-2004-0048317, filed on Jun. 25, 2004, in the Korean Intellectual Property Office, the entire content of which is incorporated herein by reference.

BACKGROUND

1. Field of the Invention

The present invention relates to a display apparatus and a displaying method thereof, and more particularly, to a display apparatus and a displaying method thereof, which can improve picture quality.

2. Discussion of Related Art

A mobile communication terminal has been widely used because it is portable. To satisfy users' various demands, the mobile communication terminal has recently been manufactured with an image display function in addition to a voice communication function.

As the mobile communication terminal begins to display images, an image display part of the mobile communication terminal is becoming very important. An example of the image display part used in the mobile communication terminal is a liquid crystal display (LCD). The LCD rearranges liquid crystals and adjusts the transmittance of light emitted from a backlight in order to display an image. However, the LCD needs the backlight, which is provided separately, thereby consuming much power. Further, the LCD has problems of narrow view angle, slow response speed, low contrast, etc. To solve these problems of the LCD, a light emitting display (LED) can be substituted for the LCD, as the image display part of the mobile communication terminal. The LED has fast response speed, high contrast, low voltage drive, wide view angle, etc.

In addition, most mobile communication terminals are equipped with a camera for photographing an image. The camera generally uses a charge coupled device (CCD) sensor or a complementary metal oxide semiconductor (CMOS) sensor as an image sensing device. The CCD sensor includes color filters for red (R), green (G) and blue (B) colors to allow light of a predetermined wavelength to pass therethrough, and an RGB sensor to charge the light passing through the color filter. The CCD sensor then converts the amount of light charged in the RGB sensor into an electrical signal, thereby creating image data. By contrast, the CMOS sensor directly receives light through a semiconductor device without a filter and converts the light into an electrical signal, thereby creating image data.

In the mobile communication terminal, a predetermined image photographed by the camera can be displayed on the image display part (e.g., light emitting display). At this time, a user can estimate whether the picture quality is good or bad on the basis of the image displayed on the image display part.

However, in the conventional mobile communication terminal, the picture quality can be deteriorated by the surrounding environment; e.g., a predetermined portion of a subject to be photographed by the camera may become relatively bright due to direct sunlight shining on the predetermined portion or the like. In fact, when a predetermined portion of the subject is very bright, it is represented as white. Because the portion is represented as white, there arises a problem in that the brightness around this portion is also increased. When the mobile communication terminal processes the image data, the image data having gradation beyond a predetermined level is represented as white. Therefore, referring to FIG. 1, when the predetermined portion of the subject is relatively bright, a portion around that bright portion of the subject is also represented as white (referring to a center portion of FIG. 1). This effect is referred to as a white clip effect, which deteriorates the picture quality.

SUMMARY OF THE INVENTION

An embodiment of the present invention provides a display apparatus and a displaying method thereof, which can improve picture quality.

One embodiment of the present invention provides a display apparatus having: a light emitting display; a camera module for taking a picture; a brightness controller for generating a voltage corresponding to a gradation value of image data transmitted from the camera module based on a gamma curve and for applying the voltage generated to the light emitting display; a controller for controlling the camera module and the brightness controller; and an image compensator for creating a control value based on an average of first brightness data corresponding to a predetermined region of a frame data transmitted from the camera module and at least one of respective average values of respective second brightness data corresponding to any other regions of the frame data transmitted from the controller, wherein the controller resets a value selected from the group consisting of an amplitude and a gradient of the gamma curve based on the control value.

According to an embodiment of the invention, the display apparatus further includes a key input part for splitting an image display part of the light emitting display into a plurality of split regions and for inputting a mode control signal for designating one of the split regions to the controller.

According to an embodiment of the invention, the image display part is split into a center region and upper, lower, right, and left regions with respect to the center region.

According to an embodiment of the invention, the mode control signal designates a relatively bright region among the plurality of split regions.

According to an embodiment of the invention, the camera module converts the image data corresponding to the one of the split regions designated by the mode control signal into the first brightness data, and transmits the first brightness data to the image compensator.

According to an embodiment of the invention, the controller converts the respective image data corresponding to other regions of the split regions excluding the one of the split regions designated by the mode control signal into the respective second brightness data, calculates the respective average values of the respective second brightness data, and transmits the respective average values of the respective second brightness data to the image compensator.

According to an embodiment of the invention, the image compensator includes: an average value calculator for calculating the average value of the first brightness data; and a comparator for creating the control value by comparing the average value of the first brightness data with at least one of the respective average values of the respective second brightness data.

According to an embodiment of the invention, the respective average values of the respective second brightness data corresponding to the other regions, excluding the one region of the split regions designated by the mode control signal, are transmitted to the image compensator in sequence.

According to an embodiment of the invention, the compensator creates the control value by subtracting at least one of the respective average values of the respective second brightness data from the average value of the first brightness data.

According to an embodiment of the invention, the brightness controller includes: a timing controller for generating a driving control signal to be transmitted to the light emitting display based on a synchronization signal transmitted from the controller and the image data; a gamma controller for generating a digital signal corresponding to the gradation value of the image data based on the gamma curve; and a gradation amplifier for converting the digital signal into a voltage value.

According to an embodiment of the invention, the gamma controller includes a red (R) gamma amplitude regulator for generating a digital signal corresponding to R data of the image data based on an R gamma curve; a green (G) gamma amplitude regulator for generating a digital signal corresponding to G data of the image data based on a G gamma curve; a blue (B) gamma amplitude regulator for generating a digital signal corresponding to B data of the image data based on a B gamma curve; and a gamma curve regulator for controlling gradients of the R, G and B gamma curves.

According to an embodiment of the invention, the controller controls the R, G and B gamma amplitude regulators on the basis of the control value to reset an amplitude of the R, G and B gamma curves.

According to an embodiment of the invention, an amplitude of each of the R, G and B gamma curves is reset to lower a brightness of an image displayed on the light emitting display.

According to an embodiment of the invention, the controller controls the gamma curve regulator on the basis of the control value to reset the gradients of the R, G and B gamma curves.

According to an embodiment of the invention, the gradients of the R, G and B gamma curves are reset to lower a brightness of an image displayed on the light emitting display.

According to an embodiment of the invention, the controller controls the R, G and B gamma amplitude regulators and the gamma curve regulator based on the control value to reset both an amplitude and the gradients of the R, G and B gamma curves.

According to an embodiment of the invention, the amplitude and the gradients of the R, G and B gamma curves are reset to lower the brightness of the image displayed on the light emitting display when the control value obtained by subtracting the at least one of the respective average values of the respective second brightness data from the average value of the first brightness data is increased.

According to an embodiment of the invention, the camera module includes: an image sensor for receiving light from a subject to be photographed; a signal converter for converting a light signal received from the image sensor into an electric signal; an analog/digital converter for converting the electric signal into a digital signal; and an image controller to create image data containing red, green, and blue (RGB) data based on the digital signal, wherein the image controller converts the image data corresponding to the one of the split regions designated by the mode control signal into the first brightness data.

According to an embodiment of the invention, the display apparatus further includes: an antenna for transmitting and receiving a wireless signal; an RF part for receiving the wireless signal from the antenna and for transmitting a signal to be transmitted to the outside to the antenna; and a data processor for decoding the signal transmitted from the RF part to the controller, and for encoding the signal transmitted from the controller to the RF part.

One embodiment of the present invention provides a displaying method of a display apparatus, the method including: inputting a mode control signal for designating one region of an image displaying part provided in a light emitting display, wherein the image displaying part of the light emitting display is split into a plurality of regions; converting a taken picture into image data; converting the image data corresponding to the one region designated by the mode control signal into first brightness data; converting the image data corresponding to other regions of the plurality of regions, excluding the one region designated by the mode control signal, into respective second brightness data; calculating an average value of the first brightness data and respective average values of the respective second brightness data; creating a control value by comparing the average value of the first brightness data with the respective average values of the respective second brightness data in sequence; and resetting a value selected from the group consisting of an amplitude and a gradient of a gamma curve based on the control value.

According to an embodiment of the invention, the control value is obtained by subtracting at least one of the respective average values of the respective second brightness data from the average value of the first brightness data.

According to an embodiment of the invention, the resetting the value comprises lowering the value selected from the group consisting of the amplitude and the gradient of the gamma curve to lower the brightness of the image displayed on the light emitting display when the control value is increased.

According to an embodiment of the invention, the mode control signal designates a relatively bright region among the plurality of regions.

According to an embodiment of the invention, the displaying method further comprises: creating a voltage value corresponding to a gradation value of the image data based on the reset gamma curve and allowing the light emitting display to display a picture based on the voltage value.

BRIEF DESCRIPTION OF THE DRAWINGS

The accompanying drawings, together with the specification, illustrate exemplary embodiments of the present invention, and, together with the description, serve to explain the principles of the invention

DETAILED DESCRIPTION

In the following detailed description, only certain exemplary embodiments of the present invention are shown and described, simply by way of illustration. As those skilled in the art would realize, the described embodiments may be modified in various different ways, all without departing from the spirit or scope of the present invention.

Figure 1:
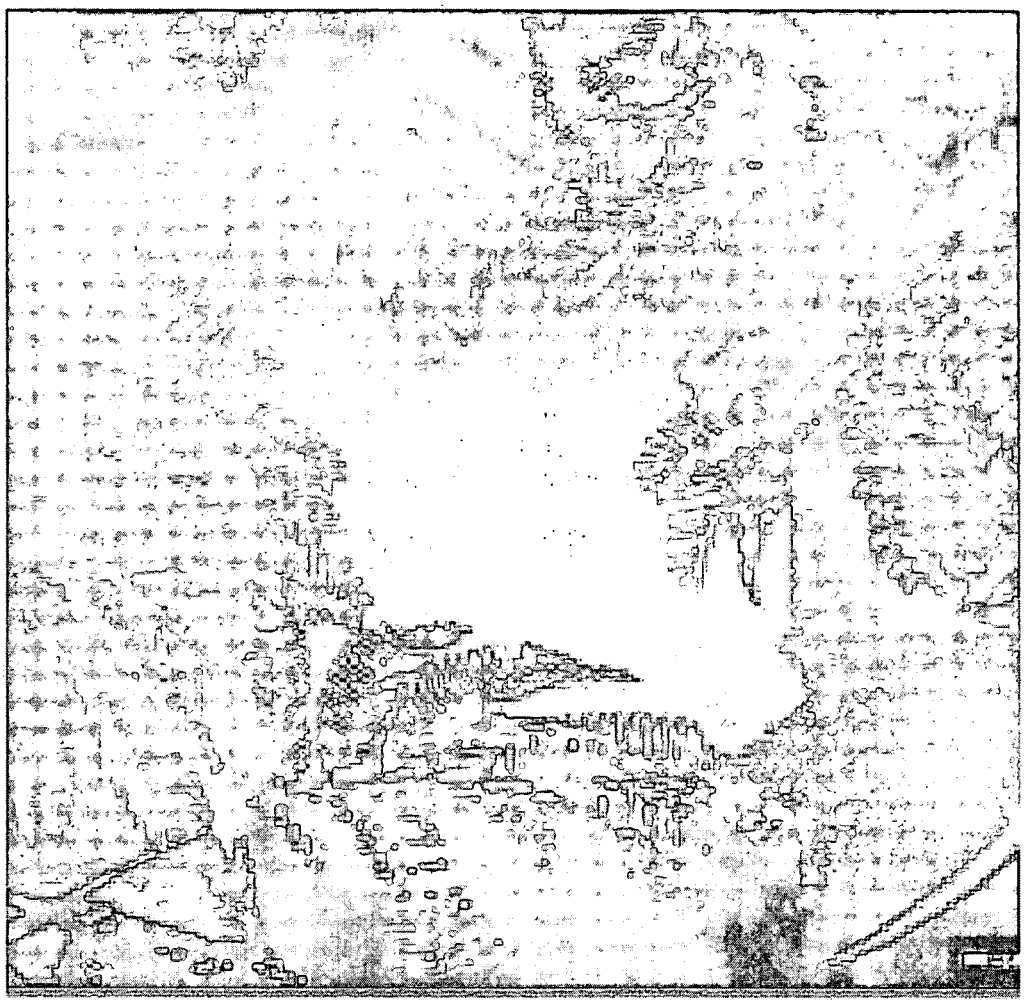
FIG. 1 (PRIOR ART)
FIG. 1 illustrates an image photographed by a conventional mobile communication terminal.
Figure 2:
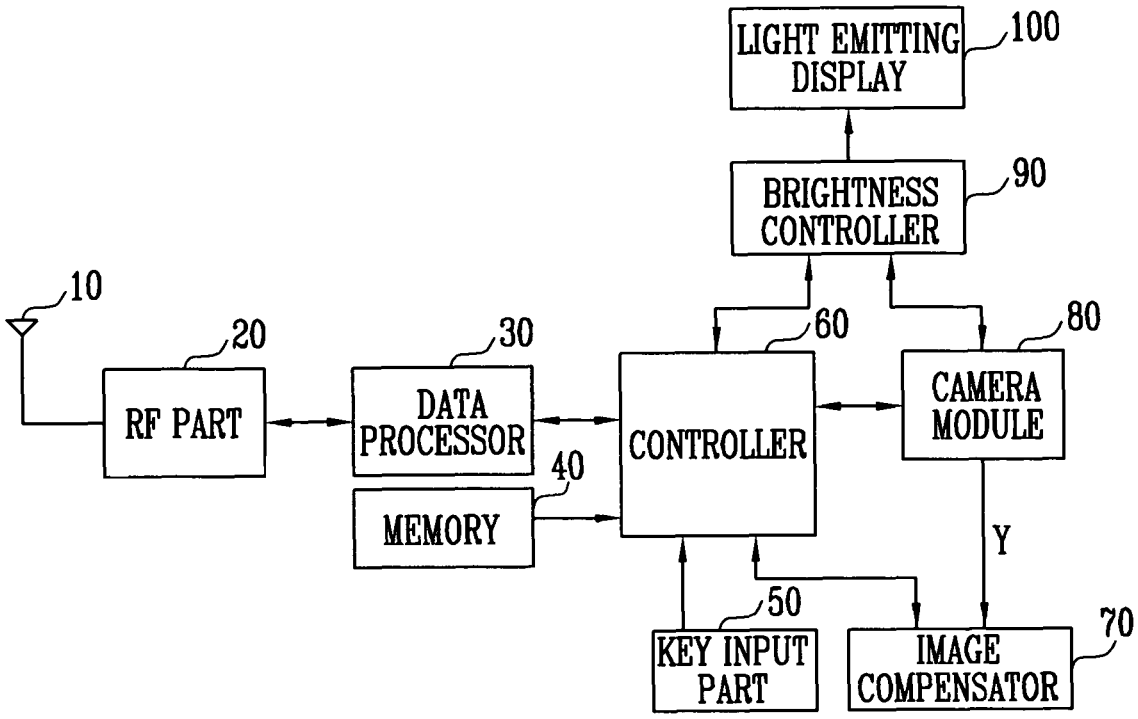
FIG. 2 is a block diagram of a display apparatus of a mobile communication terminal according to an embodiment of the present invention.

FIG. 2 is a block diagram of a display apparatus of a mobile communication terminal according to an embodiment of the present invention. Referring to FIG. 2, in the mobile communication terminal, the display apparatus includes an antenna 10, a radio frequency (RF) part 20, a data processor 30, a memory 40, a key input part 50, a controller 60, an image compensator 70, a camera module 80, a brightness controller 90, and a light emitting display 100.

The antenna 10 sends a wireless signal from the RF part 20 to the outside, and/or receives the wireless signal from the outside and provides it to the RF part 20.

The RF part 20 is used in wireless communication of the mobile communication terminal. Here, the RF part 20 includes an RF transmitter (not shown) for increasing and amplifying the frequency of a signal to be transmitted, and an RF receiver (not shown) for low-noise amplifying and decreasing the frequency the received signal. That is, the RF part 20 modulates the signal transmitted from the data processor 30 to the antenna 10, and at the same time modulates the signal transmitted from the antenna 10 to the data processor 30.

The data processor 30 decodes the signal transmitted from the RF part 20 to the controller 30, and encodes the signal transmitted from the controller 30 to the RF part 20. Here, the data processor 30 includes a modem and a codec.

The memory 40 stores programs for controlling operations of the mobile communication terminal. Further, the memory 40 stores various information such as a message, a phone number, or the like inputted from the key input part 50. In addition, the memory 40 temporarily stores data generated when the controller 60 operates, and stores an image photographed by the camera module 80.

The key input part 50 includes a plurality of keys for inputting numerals and letters, and a plurality of function keys for setting various functions. Further, a user can input a mode control signal through the key input part 50 in correspondence to a bright area of a subject. Here, the mode control signal is generated by combination of the keys for inputting the numerals and the letters, or an additional function key.

The controller 60 controls general operations of the mobile communication terminal. Here, the controller 60 includes a microcomputer (MICOM), a central processing unit (CPU), etc.

The camera module 80 is controlled by the controller 60 to photograph an external subject, and converts the photographed image into image data, thereby transmitting the image data to the controller 60 and the brightness controller 90.

The image compensator 70 compares an average brightness value of a predetermined area (corresponding to the mode control signal) with an average brightness value of the other areas having at least one area in the image photographed by the camera module 80, and then transmits a compared result (hereinafter, referred to as "control value") to the controller 60. At this time, the controller 60 lowers the brightness of the image photographed by the camera module 80 in correspondence with the control value, thereby displaying the image on the light emitting display 100. A method of controlling the brightness of the image photographed by the camera module 80 in correspondence with the control value will be described later in more detail.

The brightness controller 90 is controlled by the controller 60 to control the brightness of the image to be displayed on the light emitting display 100. Here, when the photographed image contains a predetermined portion represented as white, the controller 60 lowers a gamma value, thereby enhancing the picture quality of the image displayed on the light emitting display 100.

Figure 3:
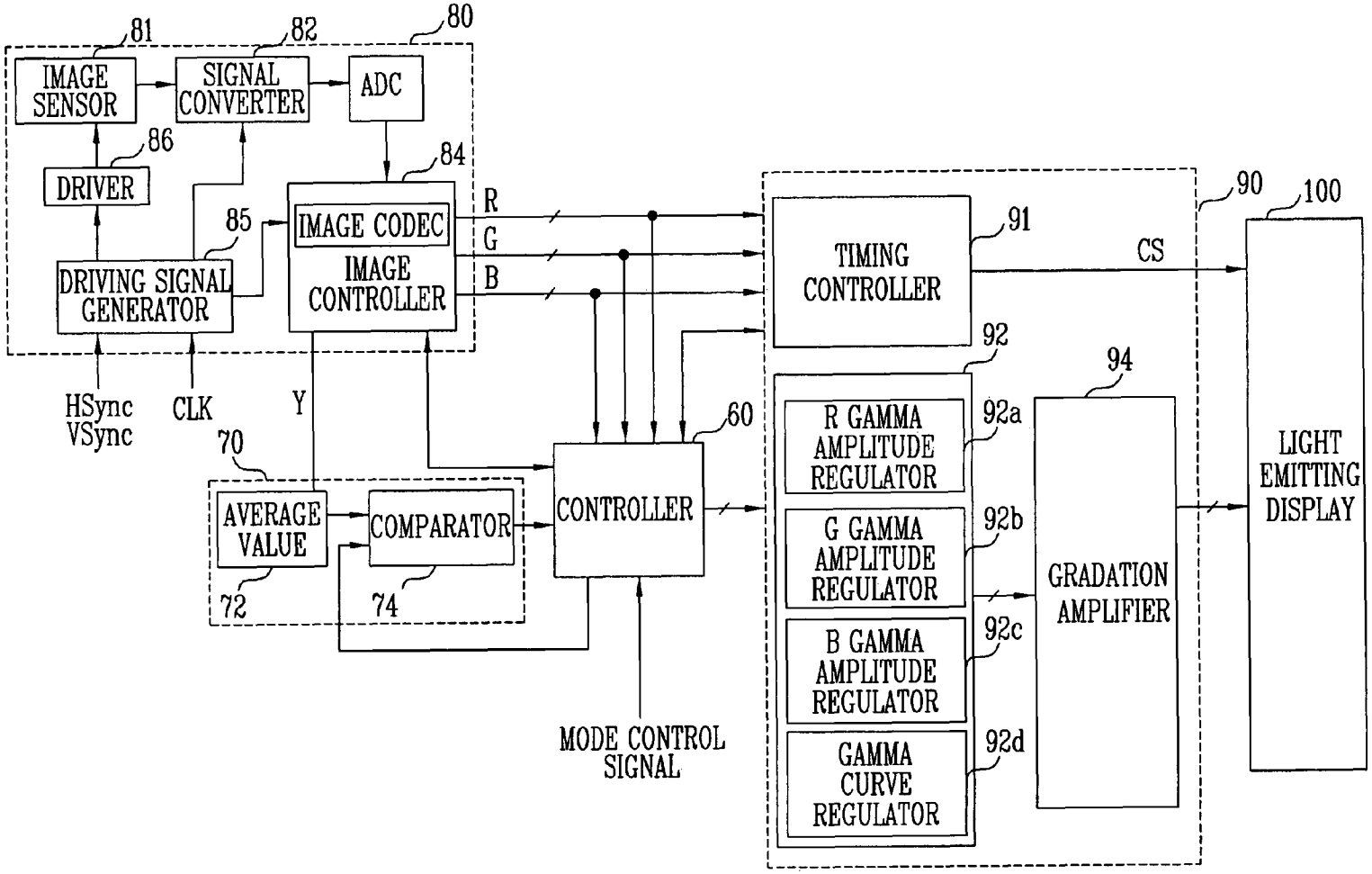
FIG. 3 is a detailed block diagram illustrating an image compensator, a camera module, and a brightness controller of FIG. 2.

FIG. 3 is a detailed block diagram illustrating the image compensator 70, the camera module 80, and the brightness controller 90 of FIG. 2.

Referring to FIG. 3, the camera module 80 includes an image sensor 81, a signal converter 82, an analog/digital converter (ADC) 83, an image controller 84, a driving signal generator 85, and a driver 86.

The driving signal generator 85 controls the driver 86 in correspondence with a control signal and synchronization signals (Hsync, Vsync, CLK) transmitted from the controller 60. For example, the driving signal generator 85 outputs a driving signal to zoom-in or zoom-out to the driver 86 when it receives a control signal to zoom-in or zoom-out from the controller 60. Then, the driver 86 controls the image sensor 81 to zoom-in or zoom-out.

The image sensor 81 receives an optical signal from the external subject when the camera module 80 photographs. Here, the intensity of the optical signal inputted to the image sensor 81 depends on the brightness of the subject. According to an embodiment of the present invention, the image sensor 81 includes a CCD sensor or a CMOS sensor. Here, the image sensor 81 can be integrally or detachably provided to the mobile communication terminal. That is, either an internal or external type image sensor 81 can be employed in the mobile communication terminal.

The signal converter 82 converts the optical signal received from the image sensor 81 into an electrical signal. For example, the signal converter 82 generates an electronic signal in proportion to the intensity of an optical signal received from the image sensor 81.

The ADC 83 converts the electric signal of an analog signal transmitted from the signal converter 82 into a digital signal, and transmits it to the image controller 84.

The image controller 84 creates the image data (RGB data) on the basis of the digital signal outputted from the signal converter 82, and transmits it to the light emitting display 100. For example, the image controller 84 creates the image data of a frame unit by processing the digital signal of the frame unit, and outputs the created image data to the controller 60 and the brightness controller 90. Further, the image controller 84 is controlled by the controller 60 to convert some of the image data of the frame unit to be transmitted to the light emitting display 100 into brightness data Y, and transmits the brightness data Y to the image compensator 70.

Further, the image controller 84 can include an image codec for coding the image data on the basis of a preset method, or decoding the encoded image data into the original data. The image controller 84 can be realized by a digital signal processor (DSP).

The image compensator 70 includes an average value calculator 72 and a comparator 74. The average value calculator 72 calculates an average value of the brightness data Y transmitted from the image controller 84, and transmits the calculated average value to the comparator 74. The comparator 74 compares the average value transmitted from the average value calculator 72 with a predetermined reference value transmitted from the controller 60, thereby transmitting the control value corresponding to difference between the average value and the reference value to the controller 60.

The controller 60 transmits a signal corresponding to the mode control signal to the image controller 84 when the mode control signal is inputted through the key input part 50. Further, the controller 60 splits the image data of the frame unit, except for the image data converted by the image controller 84 into the brightness data Y, into at least two regions. Then, the controller 60 calculates the average value of the brightness data Y contained in each region, and then transmits the calculated average value to the comparator 74. Further, the controller 60 controls the amplitude and the gradient of a gamma curve of a gamma controller 92 provided in the brightness controller 90 in correspondence with the control value transmitted from the comparator 74.

The brightness controller 90 includes a timing controller 91, the gamma controller 92, and a gradation amplifier 94. The timing controller 91 receives synchronization signals such as an Hsync signal, a Vsync signal, and a CLK signal from the controller 60. Further, the timing controller 91 receives the image data from the image controller 84. Then, the timing controller 91, having received the Hsync signal, the Vsync signal, the CLK signal, and the image data, generates a driving control signal CS to the light emitting display 100, thereby driving the light emitting display 100. In one embodiment, the driving control signal CS generated by the timing controller 91 is transmitted to a scan driver (not shown) for driving the scan line and a data line of a data driver (not shown) for driving a data line provided in the light emitting display 100. Here, the scan driver and the data driver can be internally mounted in the light emitting display 100, or separately provided in the exterior of the light emitting display 100. Likewise, the brightness controller 90 can be internally mounted in the light emitting display 100, or separately provided in the exterior of the light emitting display 100.

Figure 5A:
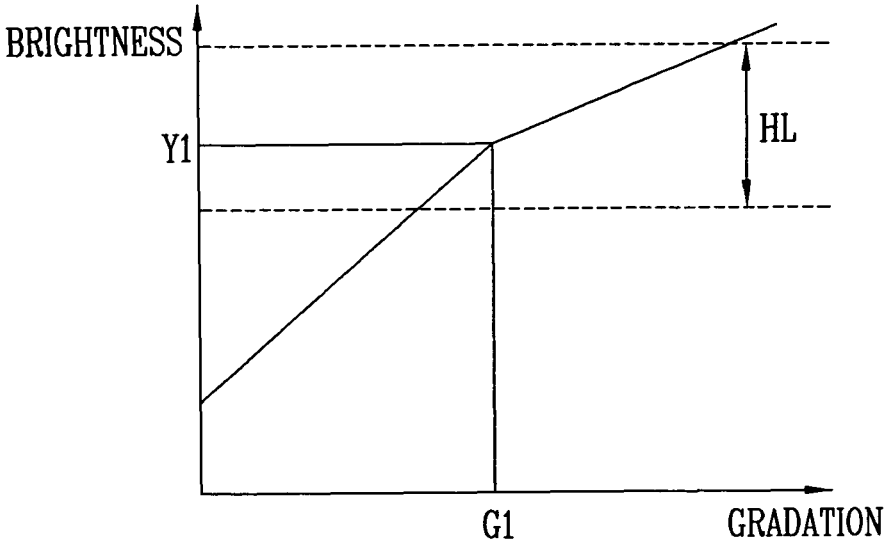
FIGS. 5A through 5D illustrate that a gamma curve is reset according to an embodiment of the present invention.

The gamma controller 92 includes an R gamma amplitude regulator 92*a*, a G gamma amplitude regulator 92*b*, a B gamma amplitude regulator 92*c* and a gamma curve regulator 92*d*. The R gamma amplitude regulator 92*a* stores a gamma value to output a voltage corresponding to a gradation value of R data among the image data. For example, the R gamma amplitude regulator 92*a* can store an R gamma curve as shown in FIG. 5A. Referring now also to FIG. 5A, when the R data having a first gradation value G1 is inputted to the R gamma amplitude regulator 92*a*, the R gamma amplitude regulator 92*a* outputs a digital signal corresponding to the first gradation value G1 to the gradation amplifier 94, thereby emitting light having a first brightness Y1. Further, the R gamma amplitude regulator 92*a* resets the amplitude of the R gamma curve as shown in FIG. 5A in correspondence with the control of the controller 60.

Referring still to FIG. 3, the G gamma amplitude regulator 92*b* stores a gamma value to output a voltage corresponding to a gradation value of G data among the image data. The G gamma amplitude regulator 92*b* generates a digital signal corresponding to a gamma value to emit light corresponding to the gradation of the G data, and transmits the digital signal to the gradation amplifier 94. Further, the G gamma amplitude regulator 92*b* resets the amplitude of a G gamma curve in correspondence with the control of the controller 60.

The B gamma amplitude regulator 92*c* stores a gamma value to output a voltage corresponding to a gradation value of B data among the image data. The B gamma amplitude regulator 92*c* generates a digital signal corresponding to a gamma value to emit light corresponding to the gradation of the B data, and transmits the digital signal to the gradation amplifier 94. Further, the B gamma amplitude regulator 92*c* resets the amplitude of a B gamma curve in correspondence with the control of the controller 60.

The gamma curve regulator 92*d* resets the gradient of the R, G and B gamma curves in correspondence with the control of the controller 60. Here, a process of allowing the gamma curve regulator 92*d* to reset the gradient of the gamma curve will be described later in more detail.

The gradation amplifier 94 converts the digital signals transmitted from the R gamma amplitude regulator 92*a*, the G gamma amplitude regulator 92*b*, and the B gamma amplitude regulator 92*c* into an analog signal (predetermined voltage), and transmits the analog signal to the light emitting display 100.

In the mobile communication terminal according to an embodiment of the present invention, the display apparatus operates as follows.

Figure 4:
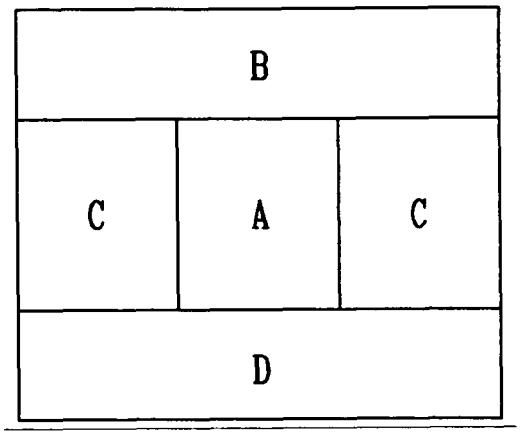
FIG. 4 illustrates split regions of a light emitting display according to an embodiment of the present invention.

A user enters a mode signal corresponding to a subject to be photographed to the controller 60. In the operation, the image display part (on which an image is displayed) of the light emitting display 100 is split into a plurality of regions A, B, C and D as shown in FIG. 4. Referring also to FIG. 4, the image display part of the light emitting display 100 is split into a center region A, an upper region B, a lower region D, and left and right regions C with respect to the center region A. The split regions of FIG. 4 are illustrated by way of example, and the image display part of the light emitting display 100 may be variously split.

After the image display part of the light emitting display 100 is split into the plurality of regions as shown in FIG. 4, the mode control signal for selecting one of these split regions is inputted to the controller 60 through the key input part 50. Here, the mode control signal for selecting one of these split regions is determined by the following Table 1.

TABLE 1

| Mode control signal | Region | Condition |
|---|---|---|
| First mode control signal | A | Spot light in the front |
| Second mode control signal | B | Sun in outdoor landscape |
| Third mode control signal | C | Backlight or light next to still life, or portrait |
| Fourth mode control signal | D | Seascape; illumination reflected off the floor |

Referring to Table 1, the mode control signal is determined with respect to a high (or bright) lighted region of the subject to be photographed. For example, a user controls the key input part 50 to input the first mode control signal to the controller 60 when the center region A among the plurality of split regions is relatively bright. Further, a user controls the key input part 50 to input the second mode control signal to the controller 60 when the upper region B among the plurality of split regions is relatively bright. Also, a user controls the key input part 50 to input the fourth mode control signal to the controller 60 when the lower region D among the plurality of split regions is relatively bright. In addition, a user can use the key input part 50 to input the third mode control signal to the controller 60 when a bright light source is disposed in the right and left regions C of the light emitting display 100. Thus, the mode control signal designates the high (or bright) lighted region A, B, C, and/or D among the plurality of split regions A, B, C, and D. Hereinafter, an embodiment of the present invention will be described on the assumption that the first mode control signal is inputted to the controller 60.

When the first mode control signal is inputted to the controller 60, the controller 60 transmits a signal corresponding to the first mode control signal to the image controller 84. Then, a user takes a picture, controlling the image sensor 81. The signal converter 82 converts an optical signal transmitted from the image sensor 81 into an electrical signal, and transmits it to the ADC 83. Then, the ADC 83 converts the electrical signal into a digital signal, thereby transmitting it to the controller 84.

The image controller 84 creates the image data (R, G and B) to be transmitted to the light emitting display 100 using the digital signal received from the ADC 83. The image data created in the image controller 84 is transmitted to the brightness controller 90 and the controller 60.

Further, the image controller 84 receives a signal corresponding to the first mode control signal from the controller 60. Here, the first mode control signal designates the center region A of a screen, so that the image controller 84 extracts the image data to be transmitted to the center region A from the one frame data, and converts the extracted image data into the brightness data Y on the basis of equation 1

$$Y=0.229\times Ri+0.587\times Gi+0.114\times Bi \qquad \text{Equation 1}$$

Here, equation 1 for converting the image data into the brightness data is shown by way of example, and the present invention is not thereby limited.

After creating the brightness data Y of the center region A, the image controller 84 transmits the brightness data Y to the average value calculator 72 of the image compensator 70. After receiving the brightness data Y, the average value calculator 72 calculates the average value of the brightness data Y (hereinafter, referred to as "first brightness value") and transmits it to the comparator 74.

Meanwhile, the controller 60 converts each received image data to be transmitted to the regions B, C and D except for the center region A into the brightness data Y, and then calculates the average value (hereinafter, referred to as "second brightness value") of each converted brightness data Y. That is, the controller 60 calculates three second brightness values corresponding to the upper region B, the lower region D and the right and left regions C.

After calculating the average value of the brightness data Y converted from the image data to be transmitted to the regions B, C and D except for the center region A, the controller 60 transmits the second brightness values of the respective regions to the comparator 74 in sequence. Here, the sequence of transmitting the second brightness values is determined in consideration of a scanning direction or the like. For convenience, an embodiment of the present invention will be described on the assumption that the second brightness value of the upper region B, the second brightness value of the right and left regions C, and the second brightness value of the lower region D are transmitted to the comparator 74 in sequence.

The comparator 74 compares the first brightness value transmitted from the average value generator 72 with the second brightness value transmitted from the controller 60. Further, the comparator 74 creates a control value by subtracting the second brightness value from the first brightness value, and transmits the created control value to the controller 60.

Figure 5B:
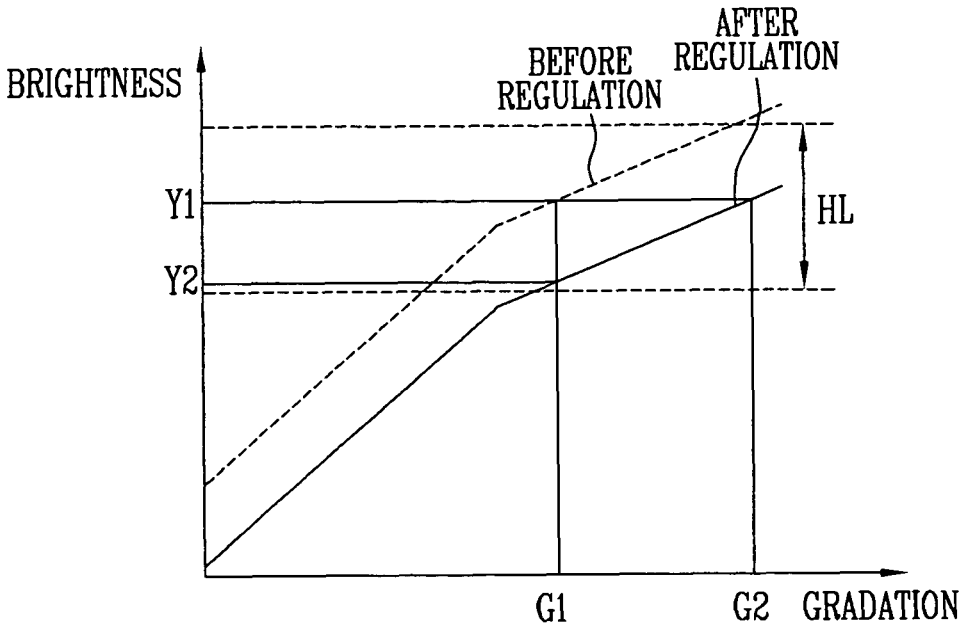

The controller 60 controls at least one of the gamma regulators 92*a*, 92*b*, 92*c* and the gamma curve regulator 92*d* on the basis of the control value received from the comparator 74, and thus controls the brightness of the light emitting display 100. Referring to FIG. 5B, the controller 60 can lower the brightness with respect to the same gradation by controlling the amplitude of the gamma curve contained in the gamma regulators 92*a*, 92*b* and 92*c*. That is, in FIG. 5B, the gamma curve is shown to be moved substantially downward. Therefore, when the image data having the first gradation value G1 is inputted, the digital signal according to an embodiment of the present invention is created to emit light having a second brightness Y2 lower than the first brightness Y1 as compared with the conventional digital signal created to emit light having the first brightness Y1. In addition, to provide the first brightness Y1 according to the embodiment of the present invention, the image data having a second gradation value G2 higher than the first gradation value G1 should be inputted in order to create the digital signal corresponding to the first brightness Y1.

Figure 6A:
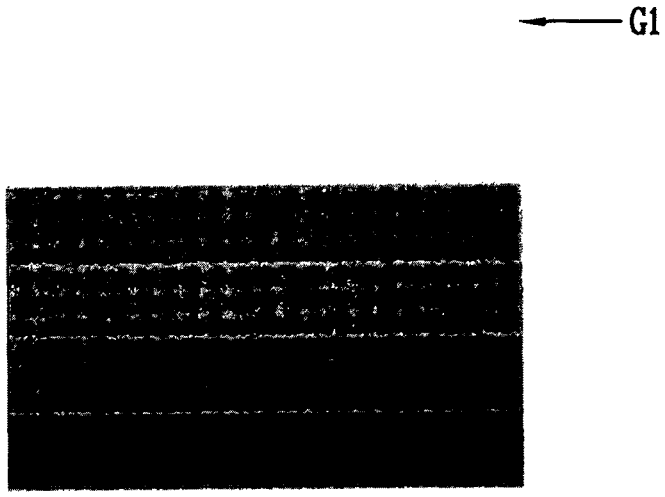
FIG. 6A (PRIOR ART)
FIGS. 6A and 6B illustrate gradations based on the reset gamma curve.
Figure 6B:
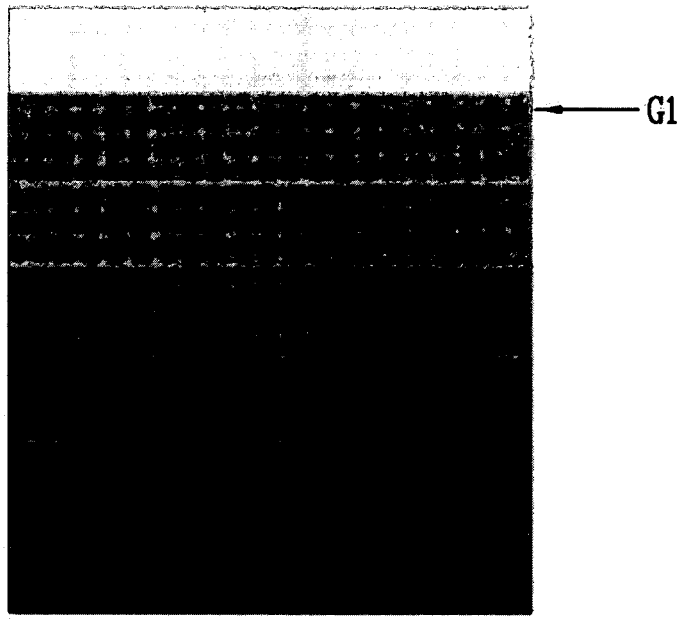

According to an embodiment of the present invention, the controller 60 resets the amplitude of the gamma curve to emit light having the brightness in a relationship that is inversely proportional to the control value transmitted from the comparator 74. That is, for example, the more the difference between the average value of the brightness data Y in the center region A and the average value of the brightness data Y in the upper region B is increased, the lower the brightness of the light is emitted by controlling the amplitude of the gamma curve. Thus, the amplitude of the gamma curve is reset to prevent a portion around a high (or bright) lighted portion of a subject to be photographed from being represented as white depending on the high (or bright) lighter portion thereof. For instance, the conventional first gradation value G1 is conventionally represented as white as shown in FIG. 6A, but the first gradation value G1 according to an embodiment of the present invention is represented as brightness lower than the white as shown in FIG. 6B. That is, according to an embodiment of the present invention, a gradation range is extended. Thus, a portion around a high (or bright) lighted portion of a subject to be photographed is prevented from being represented as white depending on the high (or bright) lighted portion thereof.

Figure 5C:
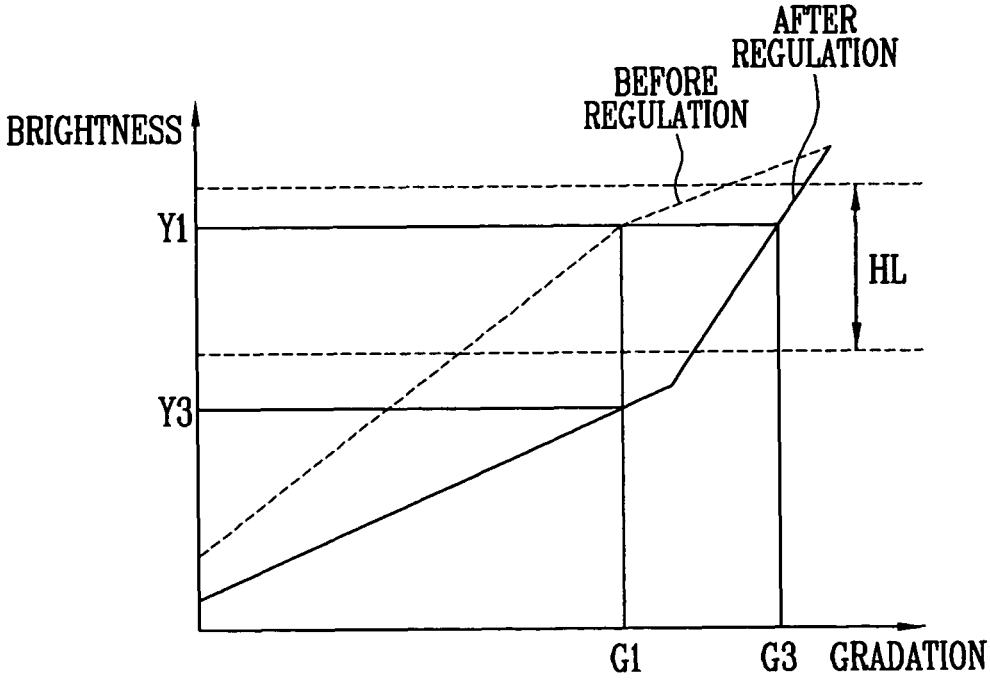

Further, referring to FIG. 5C the controller 60 can use the gamma curve regulator 92*d* to reset the gradient of the gamma curve so as to emit light having relatively low brightness with respect to the same gradation. That is, in FIG. 5C, a part of the gamma curve is shown to be moved (or sloped) substantially downward. Therefore, when the image data having the first gradation value G1 is inputted, the digital signal according to an embodiment of the present invention is created to emit light having a third brightness Y3 lower than the first brightness Y1 as compared with the conventional digital signal created to emit light having the first brightness Y1. In addition, to provide the first brightness Y1, according to the embodiment of the present invention, the image data having a third gradation value G3 higher than the first gradation value G1 should be inputted in order to create the digital signal corresponding to the first brightness Y1.

According to an embodiment of the present invention, the controller 60 resets the gradient of the gamma curve to emit light having the brightness that is inversely proportional to the control value transmitted from the comparator 74. Thus, the gradient of the gamma curve is reset to prevent a portion around a high (or bright) lighted portion of a subject to be photographed from being represented as white depending on the high (or bright) lighted portion thereof.

Figure 5D:
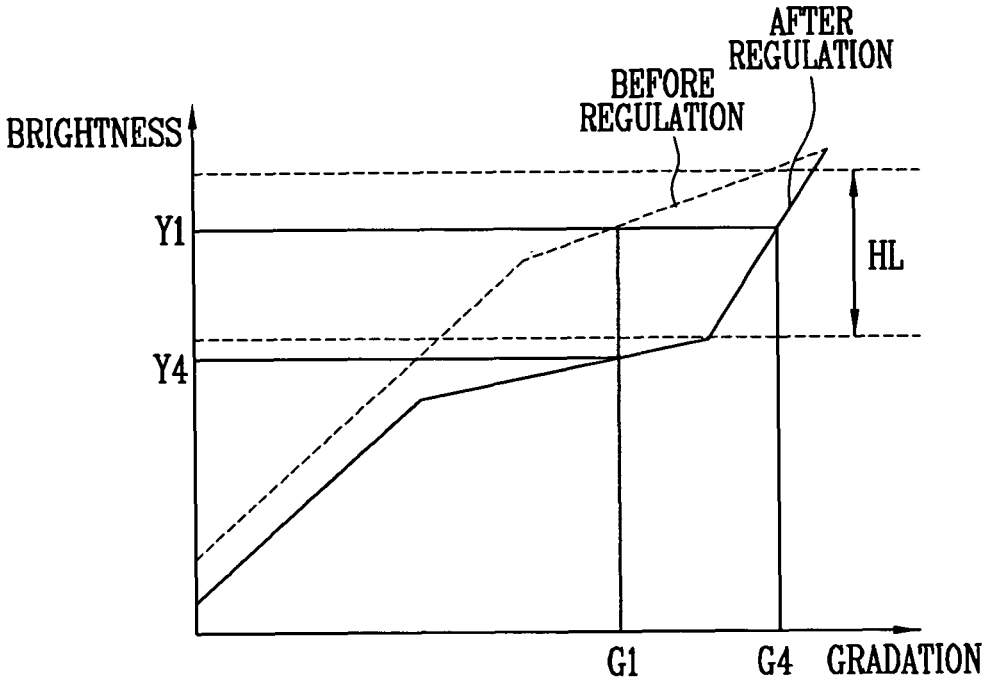

Further, referring to FIG. 5D, according to an embodiment of the present invention, the gamma regulators 92*a*, 92*b*, 92*c* and the gamma curve regulators 92*d* can be used to reset both the gradient and the amplitude of the gamma curve so as to emit light having relatively low brightness with respect to the same gradation. That is, in FIG. 5D, when the image data having the first gradation value G1 is inputted, the digital signal according to an embodiment of the present invention is created to emit light having a fourth brightness Y4 lower than the first brightness Y1 as compared with the conventional digital signal created to emit light having the first brightness Y1. In addition, to provide the first brightness Y1, according to the embodiment of the present invention, the image data having a fourth gradation value G4 higher than the first gradation value G1 should be inputted in order to create the digital signal corresponding to the first brightness Y1.

Figure 7:
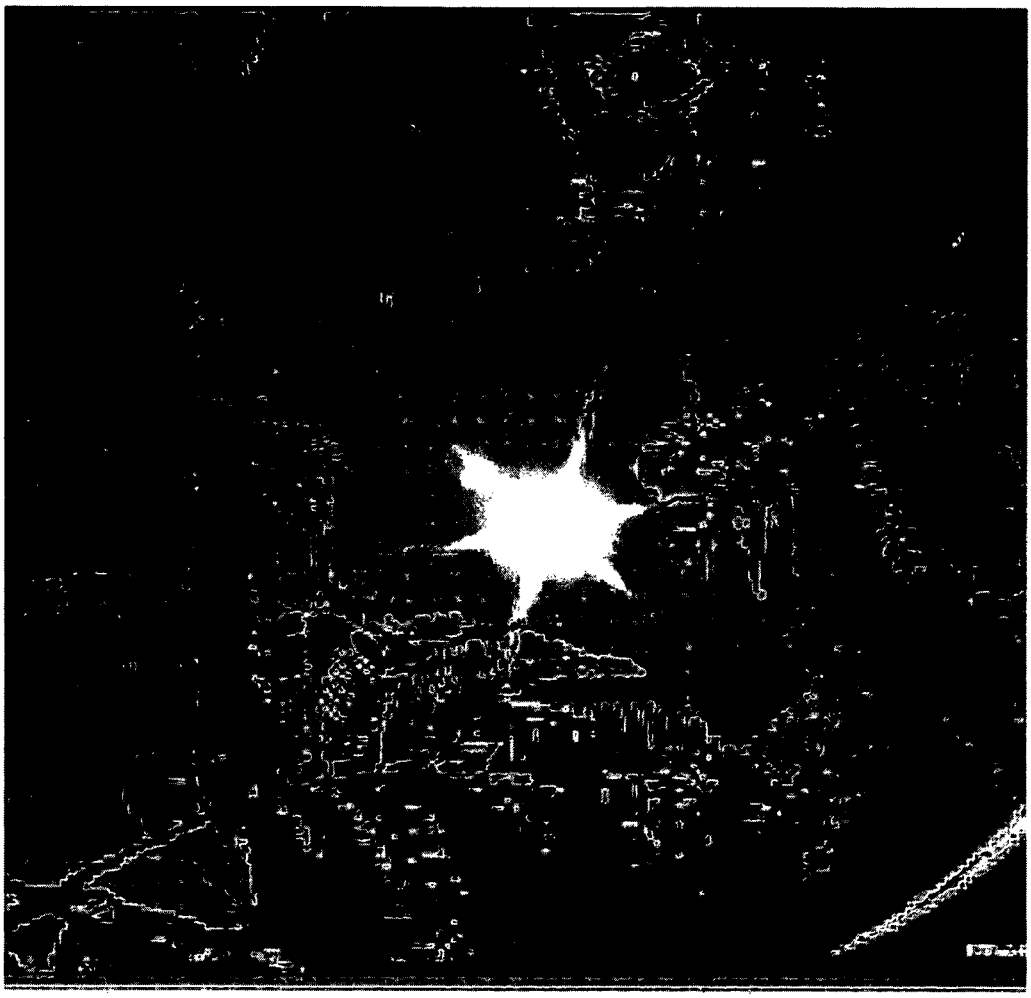
FIG. 7 illustrates an image photographed by a mobile communication terminal according to an embodiment of the present invention.

Substantially, referring also to FIGS. 4 and 7, the image data corresponding to the upper region B is converted by the reset gamma curve into an analog voltage value, so that the brightness of the upper region B is lowered as compared with the conventional brightness thereof, thereby preventing the upper region B from being represented as white depending on the brightness of the center region A (refer to FIG. 7).

Then, the controller 60 controls the comparator 74 to compare the first brightness value of the center region A with the second brightness value of the right and left regions C, and resets the gamma curve. Therefore, the image data corresponding to the right and left regions C is converted by the reset gamma curve into the analog voltage value, so that the brightness of the right and left regions C is lowered as compared with the conventional brightness thereof, thereby preventing the right and left regions C from being represented as white depending on the brightness of the center region A (refer to FIG. 7). In addition, the image data corresponding to the center regions A is converted by the reset gamma curve into the analog voltage value, so that a contrast in the center region A becomes as clear as is shown in FIG. 7.

Further, the controller 60 controls the comparator 74 to compare the first brightness value of the center region A with the second brightness value of the lower region D, and resets the gamma curve. Therefore, the image data corresponding to the lower region D is converted by the reset gamma curve into the analog voltage value, so that the brightness of the lower region D is lowered as compared with the conventional brightness thereof, thereby preventing the lower region from being represented as white depending on the brightness of the center region A (refer to FIG. 7).

According to an embodiment of the present invention, even though the image displayed on the light emitting display 100 has a high (or bright) lighted portion, a portion around the high (or bright) lighted portion is not represented as white due to the high (or bright) lighted portion (refer to FIG. 7). Thus, the light emitting display 100 according to an embodiment of the present invention improves the picture quality of an image displayed thereon. In the above-described embodiment, the process of regulating the gamma value is applied to the display apparatus employed for the mobile communication terminal by way of example and the present invention is not thereby limited. For example, an embodiment of the present invention can be applied to various suitable display apparatus that can display an image.

Figure 8:
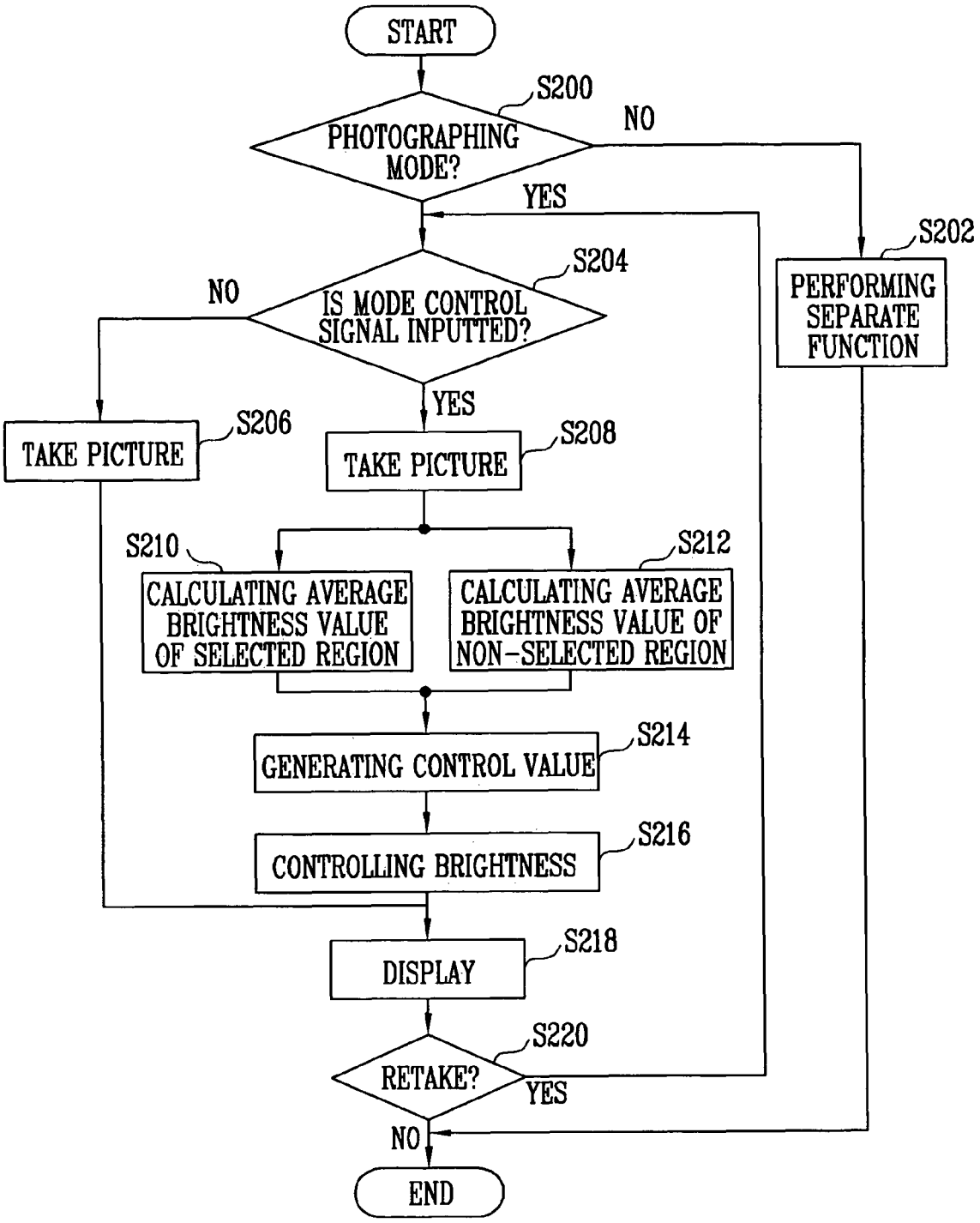
FIG. 8 is a flowchart illustrating a method of displaying an image in the mobile communication terminal according to an embodiment of the present invention.

FIG. 8 is a flowchart illustrating a method of displaying an image in the mobile communication terminal according to an embodiment of the present invention.

Referring to FIG. 8, at operation S200, the controller 60 checks whether a signal corresponding to a photographing mode is inputted through the key input part 50. When the signal corresponding to the photographing mode is not inputted, at operation S202, the controller 60 performs separate functions for controlling other components of the mobile communication terminal. Here, the separate functions can include various functions such as making a phone call, displaying a moving picture, etc.

When the signal corresponding to the photographing mode is inputted, at operation S204, the controller 60 determines whether the input signal is the mode control signal. When the input signal is not the mode control signal, at operation S206, the controller 60 controls the camera module 80 to take a picture, and at operation S218, the controller 60 controls the light emitting display 100 to display the picture thereon. That is, in the case where the mode control signal is not inputted, a picture is taken by the same method as the conventional method.

When the input signal is the mode control signal, at operation S208, the controller 60 controls the camera module 80 to take a picture. After taking the picture, at operation S210, the image controller 84 provided in the camera module 80 converts the image data corresponding to the region selected by the mode control signal into the brightness data Y, calculates the average value of the brightness data Y, and transmits it to the image compensator 70. At the same time, at operation S212, the controller 60 converts the image data corresponding to the other regions that are not selected by the mode control signal into the brightness data Y, calculates the average value of the brightness data Y, and transmits the respective average values to the image compensator 70 in sequence.

After receiving the average values of the brightness data Y in both the selected region and the other regions according to the mode control signal, at operation S214, the image compensator 70 creates the control value by subtracting the average brightness value of the other regions from the average brightness value of the region selected by the mode control signal. Here, in the case where four average brightness values are calculated at the operation S212, four control values are created in sequence.

Then, at operation S216, the controller 60 controls the brightness controller 90 to allow an image to be displayed on the light emitting display 100 having the brightness that is inversely proportional to the control value. That is, when the control value is large, i.e., when the difference between the average brightness value of the region selected by the mode control signal and the average brightness value of the other regions is large, the controller 60 controls (or lowers) the amplitude and/or the gradient of the gamma curve provided in the brightness controller 90 in order to display a picture of lowered brightness on the light emitting display 100.

At operation S218, the image, whose brightness is controlled by the brightness controller 90, is displayed on the light emitting display 100. As shown in FIG. 7, the image having a predetermined high (or bright) lighted portion is displayed on the light emitting display 100 without representing portions around the high (or bright) lighted portion as white. After displaying the image on the light emitting display 100, at operation S220, the controller 60 checks whether a signal corresponding to a retake mode is inputted through the key input part 50. When the signal corresponding to the retake mode is inputted, the controller 60 repeats predetermined operations from the operation S204. When the signal corresponding to the retake mode is not inputted, the photographing mode is finished. According to an embodiment of the present invention, the operation S220 further includes storing the displayed image data in the memory 40.

In view of the foregoing, the present invention provides a display apparatus for a mobile communication terminal and a displaying method, which controls a gamma value to lower the brightness of portions around a high (or bright) lighted portion when a subject to be photographed has the high (or bright) lighted portion, thereby preventing the portions around the high (or bright) lighted portion from being represented as white.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A display apparatus comprising:

a light emitting display;

a camera module for taking a plurality of pictures;

a brightness controller for generating a voltage corresponding to a gradation value of image data of a frame for each of the pictures transmitted from the camera module based on a gamma curve, and for applying the voltage to the light emitting display;

a controller for controlling the camera module and the brightness controller; and an image compensator for creating a control value based on an average value of first brightness data corresponding to a predetermined region of the frame transmitted from the camera module and at least one of respective average values of respective second brightness data corresponding to any other regions of the frame transmitted from the controller, wherein the controller is configured to reset a value selected from the group consisting of an amplitude and a gradient of the gamma curve based on the control value for each of the pictures, and wherein the image compensator is configured to create the control value before one of the pictures corresponding to the image date utilized to create the control value is displayed on the light emitting display.

2. The display apparatus according to claim 1, further comprising a key input part for splitting an image display part of the light emitting display into a plurality of split regions and for inputting a mode control signal for designating one of the split regions to the controller.

3. The display apparatus according to claim 2, wherein the image display part is split into a center region and upper, lower, right, and left regions with respect to the center region.

4. The display apparatus according to claim 2, wherein the mode control signal designates a relatively bright region among the plurality of split regions.

5. The display apparatus according to claim 2, wherein the camera module converts the image data corresponding to the one of the split regions designated by the mode control signal into the first brightness data, and transmits the first brightness data to the image compensator.

6. The display apparatus according to claim 5, wherein the controller converts the respective image data corresponding to other regions of the split regions excluding the one of the split regions designated by the mode control signal into the respective second brightness data, calculates the respective average values of the respective second brightness data, and transmits the respective average values of the respective second brightness data to the image compensator.

7. The display apparatus according to claim 5, wherein the camera module comprises:

an image sensor for receiving light from a subject to be photographed;

a signal converter for converting a light signal received from the image sensor into an electric signal;

an analog/digital converter for converting the electric signal into a digital signal; and an image controller for creating the image data containing red, green, and blue (RGB) data based on the digital signal, wherein the image controller converts the image data corresponding to the one of the split regions designated by the mode control signal into the first brightness data.

8. The display apparatus according to claim 6, wherein the image compensator comprises:

an average value calculator for calculating the average value of the first brightness data; and a comparator for creating the control value by comparing the average value of the first brightness data with at least one of the respective average values of the respective second brightness data.

9. The display apparatus according to claim 8, wherein the respective average values of the respective second brightness data corresponding to the other regions, excluding the one region of the split regions designated by the mode control signal, are transmitted to the image compensator in sequence.

10. The display apparatus according to claim 8, wherein the compensator creates the control value by subtracting at least one of the respective average values of the respective second brightness data from the average value of the first brightness data.

11. The display apparatus according to claim 10, wherein the brightness controller comprises:

a timing controller for generating a driving control signal to be transmitted to the light emitting display based on a synchronization signal transmitted from the controller and the image data;

a gamma controller for generating a digital signal corresponding to the gradation value of the image data based on the gamma curve; and a gradation amplifier for converting the digital signal into a voltage value.

12. The display apparatus according to claim 11, wherein the gamma controller comprises:

a red (R) gamma amplitude regulator for generating a digital signal corresponding to R data of the image data based on an R gamma curve of the gamma curve;

a green (G) gamma amplitude regulator for generating a digital signal corresponding to G data of the image data based on a G gamma curve of the gamma curve;

a blue (B) gamma amplitude regulator for generating a digital signal corresponding to B data of the image data based on a B gamma curve of the gamma curve; and a gamma curve regulator for controlling gradients of the R, G and B gamma curves.

13. The display apparatus according to claim 12, wherein the controller controls the R, G and B gamma amplitude regulators based on the control value to reset an amplitude of each of the R, G and B gamma curves.

14. The display apparatus according to claim 13, wherein an amplitude of each of the R, G and B gamma curves is reset to lower a brightness of an image displayed on the light emitting display.

15. The display apparatus according to claim 12, wherein the controller controls the gamma curve regulator based on the control value to reset the gradients of the R, G and B gamma curves.

16. The display apparatus according to claim 15, wherein the gradients of the R, G and B gamma curves are reset to lower a brightness of an image displayed on the light emitting display.

17. The display apparatus according to claim 12, wherein the controller controls the R, G and B gamma amplitude regulators and the gamma curve regulator based on the control value to reset both amplitudes and the gradients of the R, G and B gamma curves.

18. The display apparatus according to claim 17, wherein the amplitudes and the gradients of the R, G and B gamma curves are reset to lower the brightness of the image displayed on the light emitting display when the control value obtained by subtracting the at least one of the respective average values of the respective second brightness data from the average value of the first brightness data is increased.

19. The display apparatus according to claim 17, wherein the controller is configured to reset the amplitudes of the R, G and B gamma curves to control the brightness of the image displayed on the light emitting display such that the brightness of the image is inversely proportional to the control value.

20. The display apparatus according to claim 1, further comprising:

an antenna for transmitting and receiving a wireless signal;

an RF part for receiving the wireless signal from the antenna and for providing a signal to be transmitted to the outside to the antenna; and a data processor for decoding the signal provided from the RF part to the controller, and for encoding the signal provided from the controller to the RF part.

21. A displaying method of a display apparatus, the method comprising:

inputting a mode control signal for designating one region of an image displaying part provided in a light emitting display, wherein the image displaying part of the light emitting display is split into a plurality of regions;

converting a plurality of taken pictures into image data;

for each of the taken pictures:

converting the image data corresponding to the one region designated by the mode control signal into first brightness data;

converting the image data corresponding to other regions of the plurality of regions, excluding the one region designated by the mode control signal, into respective second brightness data;

calculating an average value of the first brightness data and respective average values of the respective second brightness data;

creating a control value by comparing the average value of the first brightness data with the respective average values of the respective second brightness data in sequence; and resetting a value selected from the group consisting of an amplitude and a gradient of a gamma curve based on the control value; and displaying one of the taken pictures corresponding to the image data utilized to create the control value on the light emitting display, wherein the control value is created before the one of the taken pictures is displayed on the light emitting display.

22. The displaying method according to claim 21, wherein the control value is obtained by subtracting at least one of the respective average values of the respective second brightness data from the average value of the first brightness data.

23. The displaying method according to claim 22, wherein the resetting the value comprises lowering the value selected from the group consisting of the amplitude and the gradient of the gamma curve to lower the brightness of the image displayed on the light emitting display when the control value is increased.

24. The displaying method according to claim 21, wherein the mode control signal designates a relatively bright region among the plurality of regions.

25. The displaying method according to claim 21, further comprising:

creating a voltage value corresponding to a gradation value of the image data based on the reset gamma curve; and allowing the light emitting display to display each of the pictures based on the voltage value.

* * * * *